US009089893B2

(12) United States Patent
Horigome et al.

(10) Patent No.: US 9,089,893 B2
(45) Date of Patent: Jul. 28, 2015

(54) CYLINDER LINER FOR INSERT CASTING USE

(75) Inventors: Masami Horigome, Sagae (JP); Giichiro Saito, Sagae (JP)

(73) Assignees: TPR Co., Ltd., Chiyoda-ku, Tokyo (JP); TPR Industry Co., Ltd., Sagae-shi, Yamagata (JP)

( * ) Notice: Subject to any disclaimer, the term of this patent is extended or adjusted under 35 U.S.C. 154(b) by 674 days.

(21) Appl. No.: 13/216,449

(22) Filed: Aug. 24, 2011

(65) Prior Publication Data

US 2012/0048106 A1 Mar. 1, 2012

(30) Foreign Application Priority Data

Aug. 25, 2010 (JP) ..... 2010-188016
Mar. 31, 2011 (JP) ..... 2011-077284

(51) Int. Cl.
*F02F 1/00* (2006.01)
*B22D 19/00* (2006.01)

(52) U.S. Cl.
CPC ..... *B22D 19/0009* (2013.01); *B22D 19/0081* (2013.01); *F02F 1/004* (2013.01)

(58) Field of Classification Search
CPC .. B22D 19/0009; B22D 19/0081; F02F 1/004
USPC ..... 92/169.1, 171.1; 123/668, 669
See application file for complete search history.

(56) References Cited

U.S. PATENT DOCUMENTS

| | | | | |
|---|---|---|---|---|
| 4,909,198 | A * | 3/1990 | Shiraya et al. | 123/90.51 |
| 8,402,881 | B2 * | 3/2013 | Sato et al. | 92/169.2 |
| 2003/0084567 | A1 | 5/2003 | Dickmann et al. | |
| 2005/0161187 | A1 | 7/2005 | Kodama et al. | |
| 2007/0012175 | A1 * | 1/2007 | Miyamoto et al. | 92/171.1 |
| 2007/0012177 | A1 | 1/2007 | Miyamoto et al. | |

(Continued)

FOREIGN PATENT DOCUMENTS

| | | |
|---|---|---|
| CN | 101218048 | 7/2008 |
| DE | 10150999 | 4/2003 |

(Continued)

OTHER PUBLICATIONS

JP 2009 160594 Translation.*

(Continued)

*Primary Examiner* — Dwayne J White
*Assistant Examiner* — Logan Kraft
(74) *Attorney, Agent, or Firm* — Merchant & Gould P.C.

(57) ABSTRACT

A cylinder liner for insert casting which is excellent in heat conductivity with a cylinder block is provided, the cylinder liner for insert casting of the present invention comprising a cylinder liner for insert casting 2 which is formed with projections 5 with heights of 0.3 to 1.2 mm and undercut parts 6 in a ratio of 20 to 80/cm$^2$ on an outer circumferential surface 4 over which, in turn, a thermally sprayed layer 7 is covered, wherein the thermally sprayed layer 7 is comprised of a ferrous material and wherein a ratio of a surface area of a thermally sprayed layer 7 surface at a certain region on the outer circumferential surface 4 of the liner with an area of the region is 12 to 23. The thermally sprayed layer preferably has a thickness of 0.01 to 0.2 mm. The thermally sprayed layer is preferably formed using a wire shaped thermal spraying material.

4 Claims, 3 Drawing Sheets

(56) References Cited

U.S. PATENT DOCUMENTS

| | | | |
|---|---|---|---|
| 2007/0012180 | A1 | 1/2007 | Miyamoto et al. |
| 2009/0272261 | A1 | 11/2009 | Sato et al. |

FOREIGN PATENT DOCUMENTS

| | | |
|---|---|---|
| JP | 2002-219563 | 8/2002 |
| JP | 2002-339794 | 11/2002 |
| JP | 2003-326353 | 11/2003 |
| JP | 2004-308625 | 11/2004 |
| JP | 2007-16733 | 1/2007 |
| JP | 2009-160594 | 7/2009 |
| JP | 2009-264347 | 11/2009 |
| JP | 2010-159768 | 7/2010 |

OTHER PUBLICATIONS

Chinese Office Action for corresponding CN Application No. 201110243427.0 mailed Jul. 11, 2014 (English Translation provided), 7 pages.

Japanese Office Action for corresponding JP Application No. 2011-077284 mailed Sep. 24, 2014 (English Translation provided), 1 page.

Japanese Office Action for corresponding JP Application No. 2011-077284 mailed Apr. 14, 2015 (English Translation provided), 4 pages.

* cited by examiner

CYLINDER LINER FOR INSERT CASTING USE

This application claims benefit of Serial No. 2010-188016, filed 25 Aug. 2010 in Japan and Serial No. 2011-077284, filed 31 Mar. 2011 in Japan and which applications are incorporated herein by reference. To the extent appropriate, a claim of priority is made to each of the above disclosed applications.

TECHNICAL FIELD

The present invention relates to a cylinder liner for insert casting use which is applied to a cylinder block.

BACKGROUND ART

To achieve lighter weight and smaller size in automobile engines, a cylinder block made of aluminum alloy is often fitted with cylinder liners made of cast iron. As the method for producing such a cylinder block fit with cylinder liners, the method is known of setting cylinder liners in advance in a casting mold for the cylinder block, pouring the casting material (aluminum alloy) into this casting mold, and thereby covering the outer circumferences of the cylinder liners with aluminum alloy.

In recent years, to increase engine output and lower fuel consumption, the areas near top dead center in the cylinder bores have become thermally harsher in conditions. Further, to achieve lower fuel consumption, there has been a demand to reduce the wall thicknesses between the cylinder bores so as to lighten the weight of the engine. To meet with such demands, in the past, the cylinder liners for insert casting use shown in Japanese Patent Publication (A) No. 2007-16733 have been known. These cylinder liners for insert casting use are improved in bond strength and thermal conductivity with the cylinder block. They are provided with thin undercut projections on their outer circumferential surfaces on which, in turn, thermally sprayed layers are formed. As the material of the thermally sprayed layers, an Al—Si alloy or other aluminum alloy or copper or a copper alloy is used.

SUMMARY OF INVENTION

A thermally sprayed layer changes in surface properties depending on the thermal spraying conditions. A thermally sprayed layer particular greatly changes in surface area depending on the thermal spraying conditions. The thermal conductivity of a cylinder liner for insert casting use with a cylinder block is greatly affected by the surface area of the thermally sprayed layer surface, but it is learned that if the surface area becomes larger than a certain value, the thermal conductivity stops rising.

An object of the present invention is to provide a cylinder liner for insert casting use which is excellent in heat conductivity with a cylinder block.

The present invention provides a cylinder liner for insert casting use which is formed with projections with heights of 0.3 to 1.2 mm and undercut parts in a ratio of 20 to 80/cm$^2$ on an outer circumferential surface over which, in turn, a thermally sprayed layer is covered, wherein the thermally sprayed layer is comprised of a ferrous material and wherein a ratio of a surface area of a thermally sprayed layer surface at a certain region on the outer circumferential surface of the liner with an area of the region is 12 to 23.

The area ratio is particularly preferably 12 to 20.

The surface area ratio of the thermally sprayed layer is greatly affected by the surface properties of the thermally sprayed layer. Therefore, by changing the thermal spraying conditions, it is possible to change the surface area ratio. For example, if increasing an assist air pressure at the time of thermal spraying, the thermally sprayed layer will become denser and the thermally sprayed layer will become smaller in surface area. On the other hand, if reducing the assist air pressure, the thermally sprayed layer will increase in pores, the thermally sprayed layer will be formed with increased fine surface relief shapes, and the thermally sprayed layer will increase in surface area.

If the projection heights are less than 0.3 mm, the heights of the projections which contact the cylinder block will become shorter and the bond strength will become insufficient. If over 1.2 mm, making the cylinder liner thinner becomes difficult and effective thermal conductivity cannot be obtained.

If the number of projections is less than 20/cm$^2$, the number of projections which contact the cylinder block will become smaller and the bond strength will become insufficient. If the number of projections exceeds 80/cm$^2$, almost no effect of rise of the thermal conductivity due to the thermally sprayed layer will be obtained.

If the liner outer circumferential surface has a surface area ratio of less than 12, the surface area of the outer circumferential surface of the cylinder liner which contacts the cylinder block becomes smaller and an effective thermal conductivity cannot be obtained. Even if the surface area ratio is over 23, the thermal conductivity will not become higher.

The thermally sprayed layer preferably has a thickness of 0.01 to 0.2 mm.

If the thermally sprayed layer has a thickness of less than 0.01 mm, no improvement in the thermal conductivity can be expected. If over 0.2 mm, the undercut parts of the projections will be buried in the thermally sprayed layer more often and an effective bond strength will not be able to be obtained.

The thermally sprayed layer is preferably formed using a wire shaped thermal spraying material. With a wire shaped thermal spraying material, since the molten metal is sprayed on by air, the surface roughness becomes greater and a large surface area can be easily obtained. Further, the melting temperature of the thermal spraying material is low and there is little change in the physical properties (oxidation). Further, the film forming speed is fast and the treatment time is short.

According to the cylinder liner for insert casting use of the present invention, a high heat conductivity is obtained and an improvement in engine performance is secured. By using a ferrous material for the material of the thermally sprayed layer, compared with the conventionally used Al—Si alloy, it is possible to tap abundant, low cost resources.

BEST MODE FOR CARRYING OUT INVENTION

Below, an embodiment of the present invention will be explained with reference to the drawings.

Figure 1:
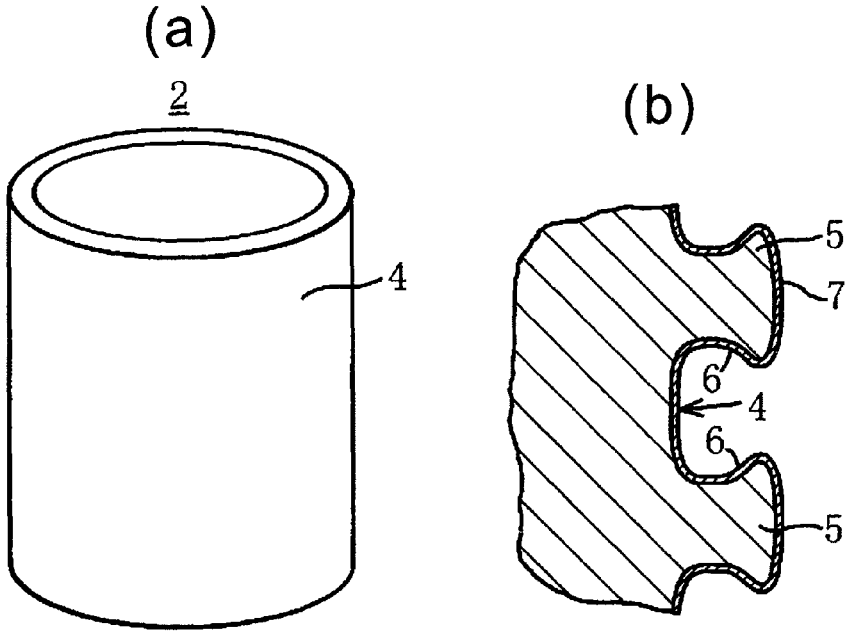
FIG. 1 shows an embodiment of the present invention, in which (a) is a perspective view of a cylinder liner for insert casting use and (b) is a cross-sectional view of an outer circumferential surface part of the same.
Figure 2:
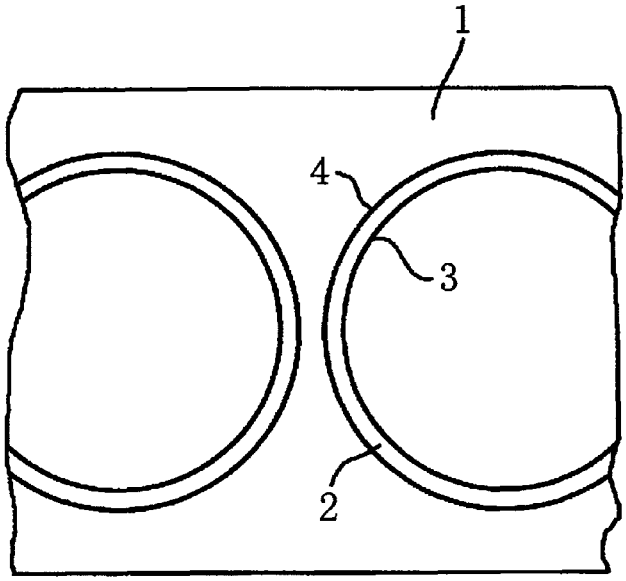
FIG. 2 is a plan view showing part of a cylinder block to which cylinder liners are attached.

FIG. 1 shows a cylinder liner, while FIG. 2 shows part of a cylinder block in which cylinder liners are fit. As the material of the cylinder block 1, considering reduction of the weight and costs, for example, JIS ADC10 (related standard: ASTM A380.0), JIS ADC12 (related standard: ASTM A383.0), or another aluminum alloy is used. As the material of the cylinder liner 2, considering wear resistance, seizing resistance, and workability, for example, JIS FC230 or another cast ion is used. One example of the composition of the cast ion is T.C: 2.9 to 3.7 (mass %, same below), Si: 1.6 to 2.8, Mn: 0.5 to 1.0, P: 0.05 to 0.4, and a balance of Fe. If necessary, Cr: 0.05 to 0.4 (mass %, same below), B: 0.03 to 0.08, and Cu: 0.3 to 0.5 may also be added.

Each cylinder liner 2 is inserted in the cylinder block 1, whereby the inner circumferential surface of the cylinder liner 2 forms a cylinder bore. That is, each cylinder liner 2 is set in advance in the casting mold for the cylinder block, then an aluminum alloy melt is poured into the casting mold. Due to this, cast ion cylinder liners 2 are present inside the aluminum alloy cylinder block 1 resulting in an insert cast structure. The cylinder liners 2 are finished at their inner circumferential surfaces and given a thickness at completion of 1.5 to 2.3 mm.

Each cylinder liner 2 is formed at its outer circumferential surface 4 with a plurality of projections 5. The projections 5 have heights of 0.3 to 1.2 mm. The number of the projections 5 is 20 to 80/cm$^2$. The projections 5 have undercut parts. As examples of the undercut parts, in the present embodiment, the projections 5 are formed into undercut shapes. That is, the projections 5 have undercut parts 6 of thin middle sections formed by being squeezed in. The cylinder liner 2 and the cylinder block 1 are joined together in a state with parts of the cylinder block 1 penetrating into the spaces around the undercut parts 6 of the projections 5 of the cylinder liner 2, whereby the bond strength between the cylinder liner 2 and the cylinder block 1 is secured.

The outer circumferential surface 4 of each cylinder liner 2 including the projections 5 is covered by a thermally sprayed layer 7. The thermally sprayed layer 7 is comprised of a ferrous material and has a thickness of 0.01 to 0.2 mm. The ratio of the surface area of the surface of the thermally sprayed layer 7 at a certain region of the outer circumferential surface 4 of the cylinder liner 2 with respect to the area of that region is 12 to 23.

The cylinder liner 2 is produced by centrifugal casting. If using centrifugal casting, it is possible to produce a cylinder liner 2 having uniform projections 5 on its outer circumferential surface 4 with a good productivity. Below, the method of production of the cylinder liner 2 will be explained.

An average particle size 0.002 to 0.02 mm diatomaceous earth, bentonite (binder), water, and a surfactant are mixed in a predetermined ratio to produce a coating material. The coating material is spray coated on the inner surface of a casting mold (mold) heated to 200 to 400° C. and kept rotating whereby a coating layer is formed on the inner surface of the casting mold. The coating layer has a thickness of 0.5 to 1.1 mm. Due to the action of the surfactant, vapor is produced inside the coating layer. Due to the bubbles, a plurality of recessed holes are formed in the coating layer. The coating layer is dried then the rotating casting mold is filled with cast iron melt. At this time, the melt fills the recessed holes of the coating layer whereby a plurality of uniform undercut projections are formed. The melt hardens to form the cylinder liner, then the cylinder liner is taken out from the casting mold together with the casting layer. This is then blasted to remove the coating layer whereby a cylinder liner which has a plurality of uniform projections on its outer circumferential surface is produced.

After this, the liner outer circumferential surface is covered by a thermally sprayed layer comprised of a ferrous material. The thermally sprayed layer is formed by wire arc spraying or flame spraying using a wire shaped thermal spraying material.

Below, results of a test of thermal conductivity for an insert cast structure comprised of a cast iron cylinder liner, which has undercut projections on its outer circumferential surface and on which a thermally sprayed layer comprised of a ferrous material is coated, around which aluminum alloy is cast to integrally join them (see Table 1) will be explained next.

In both the examples and comparative examples, the cast ion composition of the cylinder liners used for the test was as follows:

T.C: 2.9 to 3.7 (mass %, same below), Si: 1.6 to 2.8, Mn: 0.5 to 1.0, P: 0.05 to 0.4, Cr: 0.05 to 0.4, balance of Fe.

Examples and comparative examples of cylinder liners were prepared by the above-mentioned method of production. For the material of the thermally sprayed layers of the cylinder liners, as a ferrous material, a ferrous weld material corresponding to JIS 23312 was used. The thickness of the thermally sprayed layers was 0.2 mm.

Figure 3:
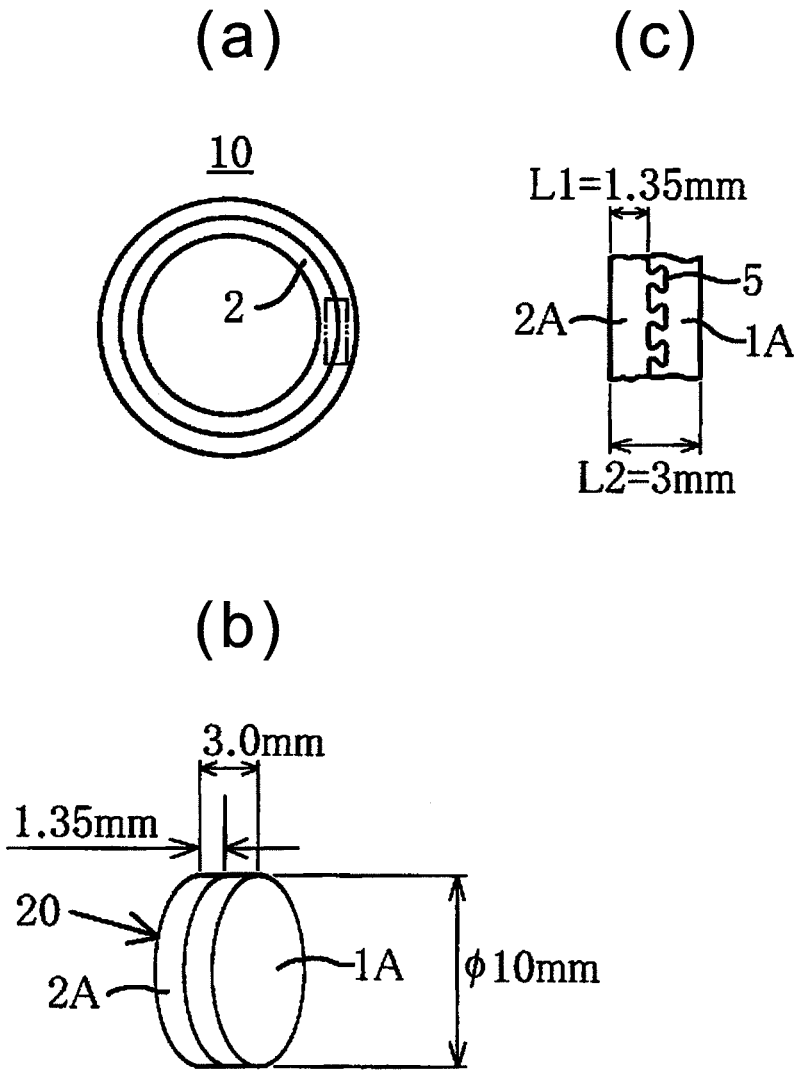
FIG. 3 explains preparation of a test piece, wherein (a) is a plan view showing an insert cast structure, (b) is a perspective view showing a test piece cut out from an insert cast structure, and (c) is a view showing part of a test piece.

A cast iron cylinder liner 2, which has undercut projections on its outer circumferential surface and on which a thermally sprayed layer comprised of a ferrous material is coated, was covered by cast aluminum alloy whereby a test-use insert cast structure 10 (see FIG. 3(*a*)) was produced.

In both the examples and comparative examples, the aluminum alloy used for the test was JIS ADC12 aluminum alloy.

1. Projection height: A depth dial gauge was used to measure the cylinder liner 2 for projection height. The measured projection heights are shown in Table 1.

2. Number of projections: A non-contact 3D laser shape measuring device was used to find contour lines of projections from the bases of the projections 5 to positions of height 0.2 mm. The number of closed contour lines in a 10 mm×10 mm range was made the number of projections per cm$^2$. The measured numbers of projections are shown in Table 1.

3. Surface area ratio: The surface area of the thermally sprayed layer at a certain region (vertical 10 mm×horizontal 10 mm) of the outer circumferential surface of the cylinder liner was measured by a 3D laser microscope at a magnification of 200× and a resolution of 0.001 μm. The surface area ratio is the ratio of the surface area resulting from the surface shape of an object at an area of a designated region to the area of that designated region. In the present invention, the surface area ratio was measured as the ratio of the surface area of the thermally sprayed layer surface having micro roughness in a designated certain region (vertical 10 mm×horizontal 10 mm) (100 mm$^2$) with respect to the designated certain region.

Figure 4:
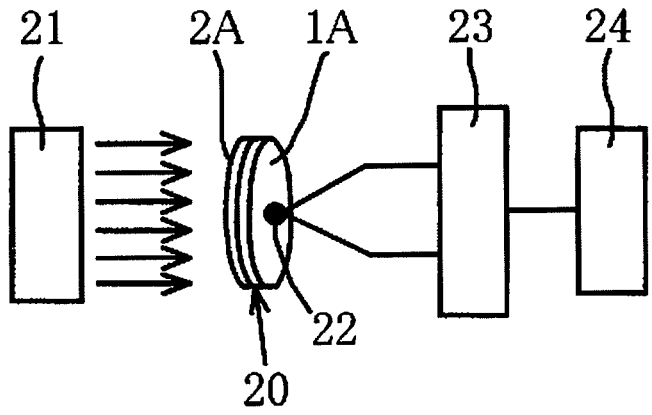
FIG. 4 is a view showing a method of measurement of thermal conductivity.

4. Thermal conductivity: The thermal conductivity was found by the laser flash method. As shown in FIG. 3, a test piece 20 is cut out from the insert cast structure 10 so that L1/L2=0.45 wherein the thickness of the cast iron part 2A down to the bases of the projections 5 is L1 and the thickness of the joined part of the cast iron part 2A and the aluminum alloy part 1A is L2. The two-dot chain line which is shown in FIG. 3(*a*) shows the cutting line. That is, the test piece 20 was cut out from an insert cast structure 10 so as to give an outside diameter of 10 mm, a thickness of 1.35 mm of the cast iron part 2A down to the base of the projection 5, and a thickness of 3 mm of a joined part of the cast iron part 2A and aluminum alloy part 1A. The thermal conductivity was calculated by measuring the time from the start of laser firing to when heat was conducted to the back surface of the test piece 20 and using the thickness of the test piece 20. In FIG. 4, 20 indicates a test piece, 21 a laser device, 22 a thermocouple, 23 a DC amplifier, and 24 a recorder. The thermal conductivity is preferably 35 W/m·K or more.

Figure 5:
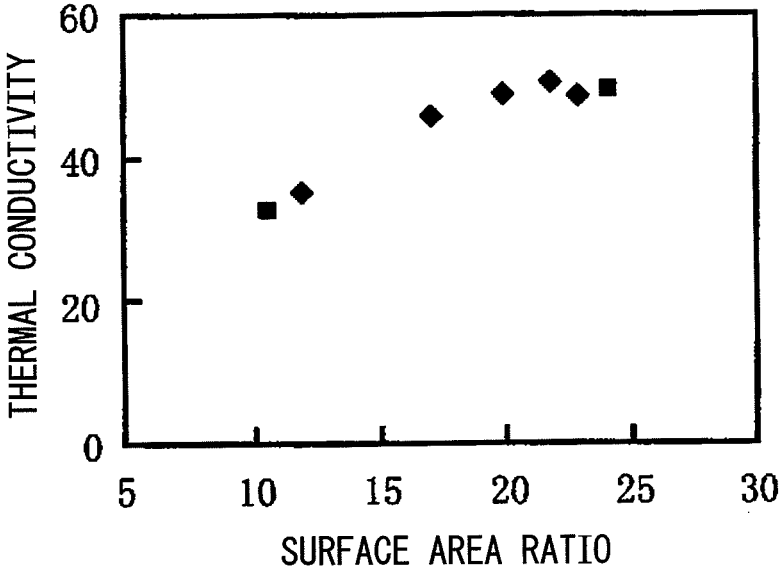
FIG. 5 is a graph showing test results of thermal conductivity.

Table 1 shows the test results. The test pieces of the examples and comparative examples were changed in thermal spraying conditions to change the surface area ratios. As shown in Table 1 and FIG. 5, if the surface area ratio is less than 12, the surface area over which the cylinder liner contacts the cylinder block is small, the thermal conductivity becomes less than 35 W/m·K, and an effective thermal conductivity cannot be obtained.

TABLE 1

| | Surface area ratio | Thermal conductivity, W/mK | Thermally sprayed layer thickness, mm | Projection height, mm | Number of projections/$cm^2$ |
|---|---|---|---|---|---|
| Ex. 1 | 12.0 | 35.0 | 0.2 | 0.3 | 20 |
| Ex. 2 | 17.2 | 45.2 | 0.2 | 0.7 | 30 |
| Ex. 3 | 20.0 | 48.5 | 0.2 | 0.7 | 30 |
| Ex. 4 | 21.9 | 50.1 | 0.2 | 0.7 | 30 |
| Ex. 5 | 23.0 | 48.0 | 0.2 | 0.3 | 20 |
| Ex. 6 | 23.0 | 48.1 | 0.2 | 1.2 | 80 |
| Comp. Ex. 1 | 10.7 | 32.2 | 0.2 | 0.7 | 30 |
| Comp. Ex. 2 | 24.2 | 49.0 | 0.2 | 0.7 | 30 |

Note that in the above embodiments, as the projections having the undercut parts, undercut projections were shown, but the projections having the undercut parts are not limited to the above shapes.

EXPLANATION OF NOTATIONS

1 cylinder block
1A aluminum alloy part
2 cylinder liner
2A cast iron part
3 inner circumferential surface
4 outer circumferential surface
5 projection
6 undercut part
7 thermally sprayed layer
10 insert cast structure
L1 thickness of cast iron part down to base of projections
L2 thickness of joined part of cast iron part and aluminum alloy part
20 test piece
21 laser device
22 thermocouple
23 DC amplifier
24 recorder

The invention claimed is:

1. A cylinder liner for insert casting which is formed with projections with heights of 0.3 to 1.2 mm and undercut parts in a ratio of 20 to 80/$cm^2$ on an outer circumferential surface over which, in turn, a thermally sprayed layer is covered, wherein said thermally sprayed layer is comprised of a ferrous material and wherein a ratio of a surface area of a thermally sprayed layer surface at a certain region on the outer circumferential surface of said liner with an area of said region is 12 to 23.

2. A cylinder liner for insert casting as set forth in claim 1, wherein said area ratio is 12 to 20.

3. A cylinder liner for insert casting as set forth in claim 1, wherein said thermally sprayed layer has a thickness of 0.01 to 0.2 mm.

4. A cylinder liner for insert casting as set forth in claim 1, wherein said thermally sprayed layer is formed using a wire shaped thermal spraying material.

* * * * *